US005221091A

United States Patent [19]

Gallegos et al.

[11] Patent Number: 5,221,091

[45] Date of Patent: Jun. 22, 1993

[54] SPORTS CARD AND BOARD GAME

[76] Inventors: Robert A. Gallegos; Anthony E. Gallegos; Dawn Gallegos, all of 891 S. Wolff, Denver, Colo. 80219

[21] Appl. No.: 945,368

[22] Filed: Sep. 16, 1992

[51] Int. Cl.[5] ..... A63F 3/00

[52] U.S. Cl. ..... 273/247; 273/249; 273/256

[58] Field of Search ..... 273/244, 243, 247, 249, 273/256

[56] References Cited

U.S. PATENT DOCUMENTS

| | | | |
|---|---|---|---|
| 635,898 | 10/1899 | Prendergast | 273/236 |
| 1,525,944 | 2/1925 | Marteka | 273/243 |
| 2,615,718 | 10/1952 | Robbins, Jr. | 273/243 |
| 3,033,572 | 5/1962 | Thibault | 273/243 |
| 3,759,520 | 9/1973 | Straitwell, Jr. | 273/243 |
| 4,010,957 | 3/1977 | Tricoli | 273/256 |
| 4,027,882 | 6/1977 | Rosenberg | 273/256 |
| 4,486,022 | 12/1984 | Dixon | 273/256 |
| 4,915,391 | 4/1990 | Aharonian | 273/256 |

*Primary Examiner*—Benjamin H. Layno
*Attorney, Agent, or Firm*—Richard C. Litman

[57] ABSTRACT

A board game in which players acquire, then sell, sports cards. Each player is represented by a piece which traverses, in rotating turns, a common path along the board. Progress along the path is determined by a throw of a die. Upon his or her piece landing on a given square, a player makes a purchasing decision relating to a sports card represented by the square. Certain squares along the path are associated with instructions affecting a player's amassed wealth. After traversing the board, a second game phase begins in which acquired sports cards are surrendered for symbolic value, the disposal value being determined by further die throws. In this second phase, the color of a die face rather than the die numerical indicia determines disposal value. The player amassing the greatest symbolic value wins.

7 Claims, 4 Drawing Sheets

SPORTS CARD AND BOARD GAME

BACKGROUND OF THE INVENTION

1. Field of the Invention

The present invention relates to board games, and more particularly, to a board game including assets having variable acquisition costs and disposal value, and in which game a chance device includes numerical indicia and color, thereby to influence a game outcome.

2. Description of the Prior Art

Board games have long been known. The geographic board game of U.S. Pat. No. 635,898, issued to J. Prendergast on Oct. 31, 1899, discloses a board subdivided into entities for acquisition by the game players, the entities bearing varying numerical values.

In U.S. Pat. No. 1,525,944, issued on Feb. 10, 1925, inventor A. Marteka provides a board game in which progress of player pieces is determined by a chance device being, in this case, a top having faces bearing numerical indicia.

Board games including elements symbolic of money or other numerical means to keep score; cards providing instructions relating to a particular move or game episode; and dice have gained in popularity since emergence of early board games. Exemplary are U.S. Pat. No. 2,615,718, issued to R. L. Robbins, Jr. on Oct. 28, 1952; 3,033,572, issued to G. O. Thibault on May 8, 1962; and 3,759,520, issued to H. L. Straitwell, Jr. on Sep. 18, 1973. Robbins, Jr. provides, in addition to a board and player pieces progressing across the board, cards, chips symbolic of money, apparatus equivalent to dice in which color as well as numerical indicia have significance, and symbolic assets for acquisition and sale to other players. The game of Robbins, Jr. is played in two active phases, a final tallying phase determining the game winner.

The Thibault '572 and '520 patents further illustrate board games including dice, cards, and player pieces.

In the above prior art, the respective game boards and methods of play differ; therefore, none of the above inventions and patents, taken either singly or in combination, is seen to describe the instant invention as claimed.

SUMMARY OF THE INVENTION

The present invention comprises a board game centered about the theme of sports cards, the acquisition thereof, and ultimate sale thereof for profit, the player having the greatest final monetary gain therefrom being declared the winner. In a first phase, players move game pieces along a path on a game board, acquiring assets in the form of simulated sports cards. The throw of a die determines both progress along the board, and cost of each card to be acquired.

In a second phase, after all participants have completed the first phase, the acquired cards are surrendered for symbolic value. The same die is thrown to determine selling price of the cards, a colored die facet in large part determining price rather than numerical die indicia playing this role. After the selling phase of the game, players tally their respective gain, the highest amassed symbolic value determining the game winner.

Accordingly, it is a principal object of the invention to provide a board game employing game pieces and a chance device, in which game assets simulating sports cards are acquired and sold.

It is another object of the invention to employ a chance device bearing symbols and color, both selectively being employed in determining a game outcome.

It is a further object of the invention to provide a board game in which game assets having selectively variable acquisition and disposal prices are acquired and sold.

Still another object of the invention is to provide a board game in which areas of the board direct a player to gain or lose game assets.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a board game which may be played by two or more players. The game is played in two phases, followed by tallying each player's amassed wealth, the greatest amassed wealth determining the winner.

Figure 1:
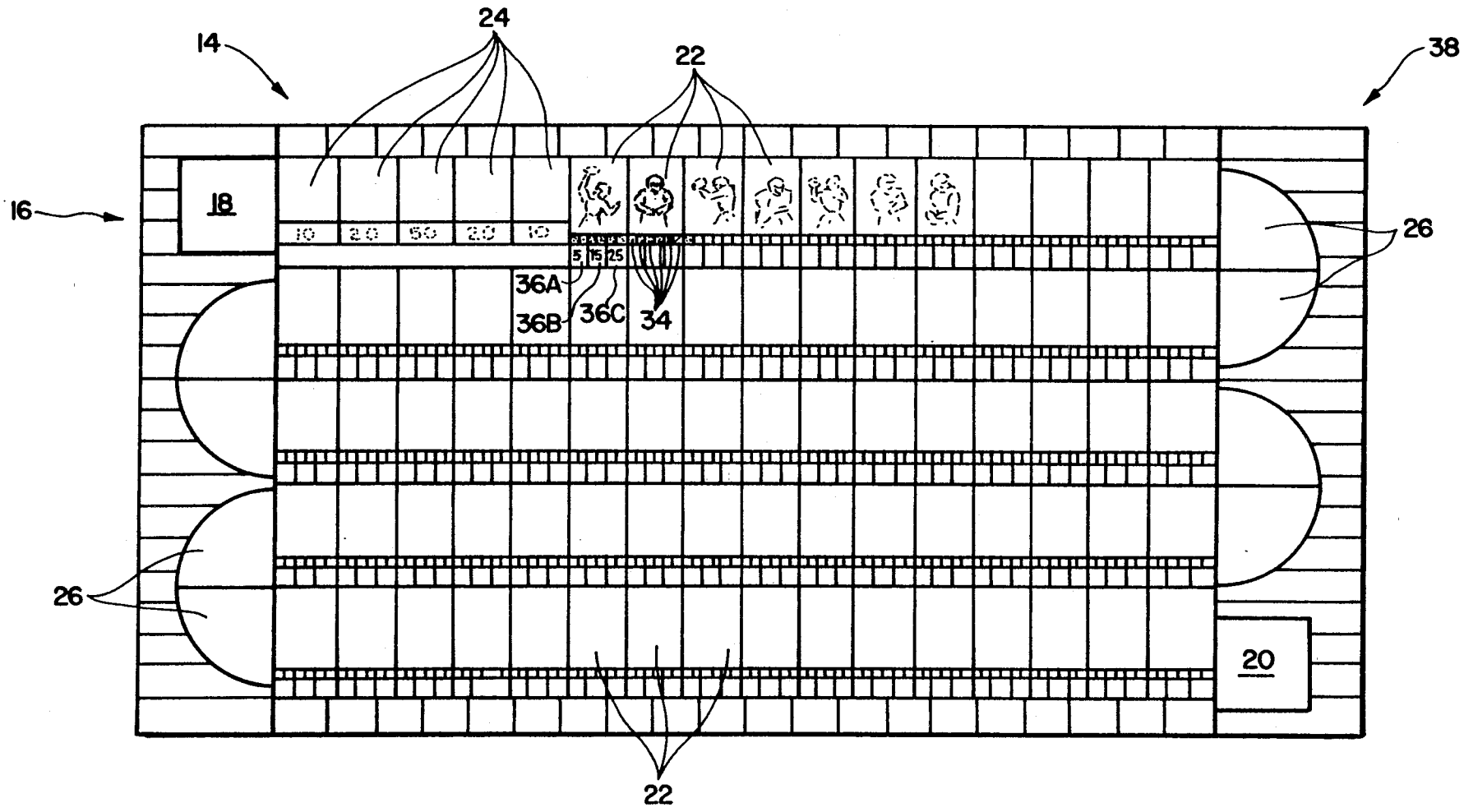
FIG. 1 is a top plan view of the game board of the present invention.
Figure 8:
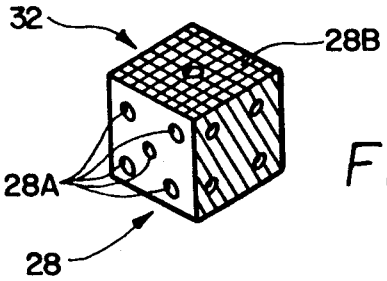
FIG. 8 is a perspective view of a die, as used in the novel game.
Figure 5:
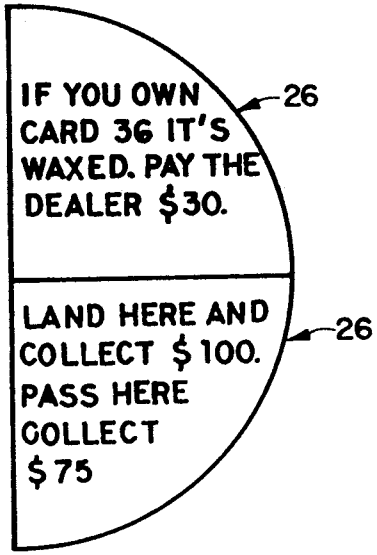
Figure 4:
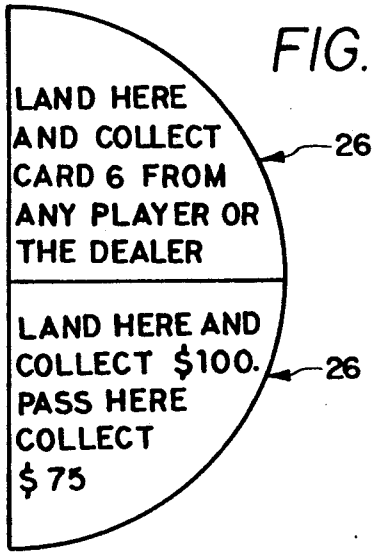
Figure 9:
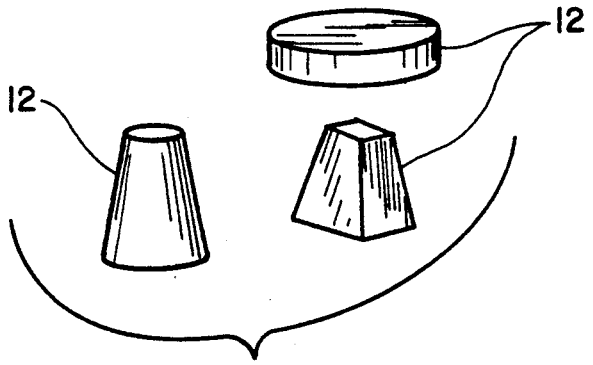
FIG. 9 is a perspective view of game pieces used in the novel game.
Figure 10:
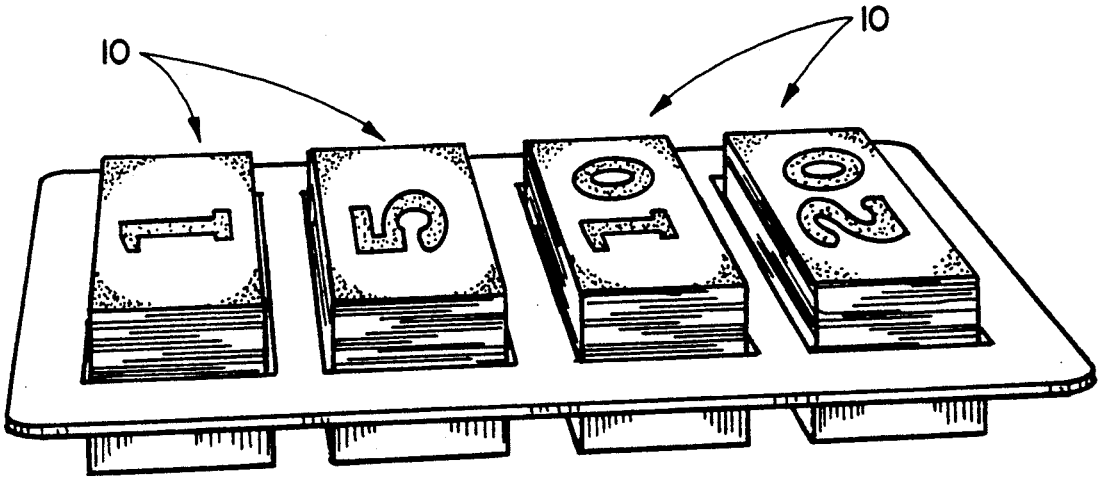
FIG. 10 is a perspective view of scrip, as used in the game.

Each player starts with a predetermined amount of symbolic value, represented preferably by scrip 10 (shown in FIG. 10). In the first phase, and in rotating turn, each player moves a game piece 12 (FIG. 9) along a board 14 (shown in its entirety in FIG. 1). The game piece 12 follows a path 16 defined by a sequence of spaces 18,20,22,24,26, starting at an initial space 18 and following the path 16 to its final space 20. The first player to take a turn is determined by throw of a die 28, illustrated in FIG. 8, bearing conventional numerical indicia 28A, the highest number thrown determining the first to play. Although a plurality of die facets 32 are visible after being thrown and coming to rest upon the game board 14, or other flat horizontal surface agreed to by the players, the facet 32 facing upwardly will be understood to be "exposed", and thus determine which die number is employed in play.

Figure 3:
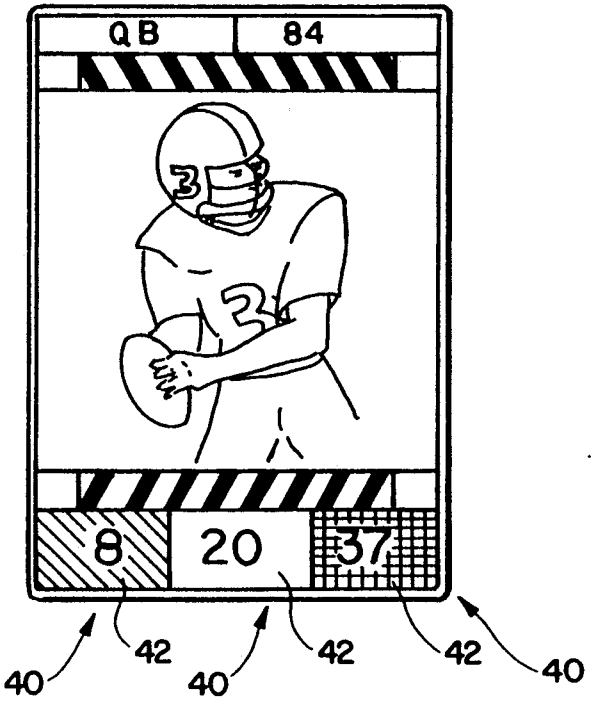
FIG. 3 is a top plan detail view of a typical sports card of the present invention.
Figure 2:
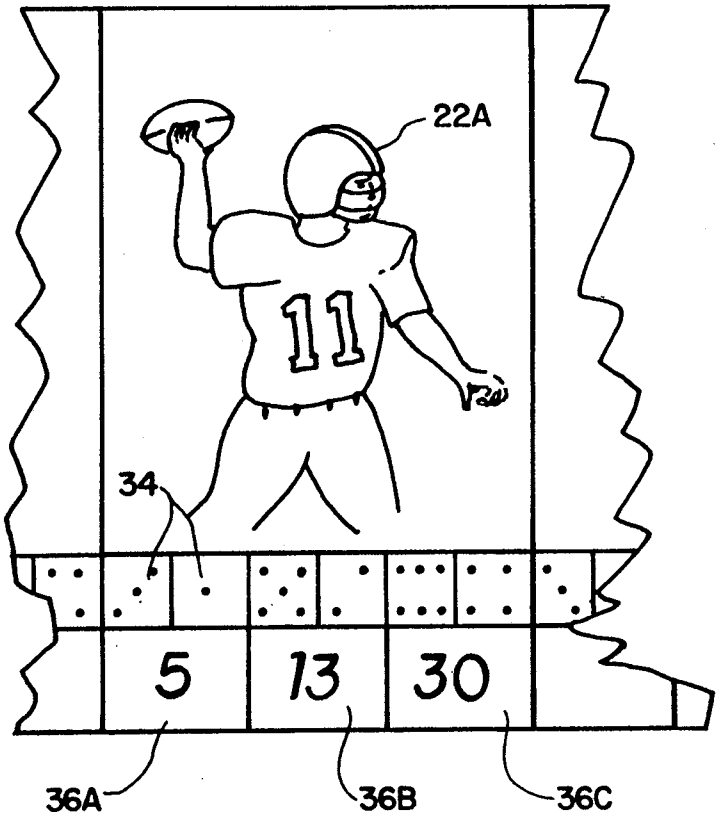
FIG. 2 is a top plan detail view of a typical game board square of FIG. 1.
Figure 7:
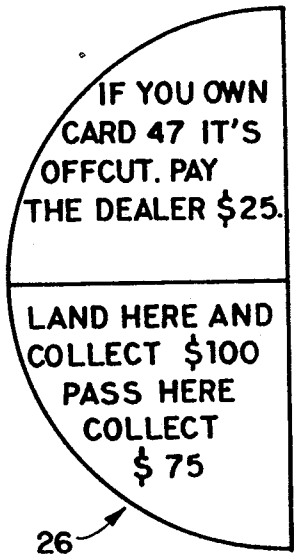
FIGS. 4, 5, 6, and 7 are top plan detail views of certain spaces on the game board.
Figure 6:
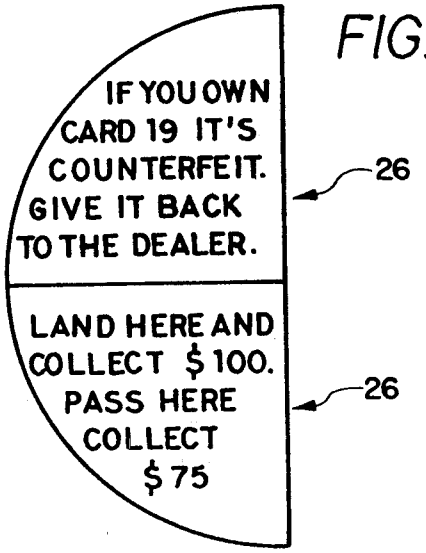

In this first game phase, players acquire assets, represented by sports cards 30, as exemplified in FIG. 3. Acquisition is performed by landing on a space 22 (shown in detail in FIG. 2) associated with a particular card 30, and purchasing the associated card 30 from a symbolic central authority, e.g., a banker (not illustrated). Usually, a particular player is designated by common consent to undertake the role of the banker, in addition to his or her normal role. This additional role is merely a necessary administrative task, and has no bearing on that player's fortunes.

The banker distributes and collects scrip 10 and sports cards 30 to and from the players. Players may also engage in purchasing transactions among themselves. Progress is determined by the throw of the die 28, a given game piece 12 moving a number of spaces 18, 20, 22, 24, 26 corresponding to a number displayed on an exposed facet 32 of die 28. The game piece 12 comes to rest upon, or occupy, a space 18, 20, 22, 24, or 26 so determined. The player is then obliged to follow directions printed on that space 18, 20, 22, 24, or 26. On spaces 22, the player is entitled to acquire sports cards 30, within his or her financial ability.

Starting from the initial space 18, game pieces 12 first traverse several spaces 24 bearing indicia representing symbolic value. Upon his or her game piece 12 landing on one of these spaces 24, a player is entitled to additional symbolic value, payable in scrip 10.

After traversing these initial several spaces 24, each game piece 12 traverses a series of spaces 22 corresponding to sports cards 30. The game apparatus includes a deck of corresponding sports cards 30 including five of each type illustrated upon each board space 22, there being seventy-five card types. Upon landing on each such space 22, the player makes a decision whether to purchase associated sports cards 30. The acquisition cost is determined by the die 28 in the following manner.

Each board space 22 bears an image 22A of a sports figure, indicia 34 corresponding to die indicia 28A, and indicia representing three numbers 36A, 36B, 36C determining acquisition cost. The actual acquisition cost is that number 36A, 36B or 36C located on the space 22 directly below indicia 34. The player may elect to acquire up to three of these cards 30 at the determined price, subject to his or her available scrip total, and the number of the particular card type remaining available at the time of the player's decision. The total sum due is paid to the banker in scrip 10, and cards 30 thus acquired are distributed to the purchaser by the banker.

The path 16 is laid out in rows 38 of spaces 22, 24, 26, there being end spaces 26 having characteristic pie slice configuration. Preferred end spaces 26 are shown in FIGS. 4, 5, 6, and 7. End spaces 26 have specified instructions which a player must follow upon his or her game piece 12 moving to occupy that space 26. Upon turning a corner described by end spaces 26, the game piece 12 traverses the next row 38, finally attaining the final space 20.

Play proceeds on a rotating basis, until all players have finished traversing the game board 14.

After all game pieces 12 have attained final space 20, the first phase ends and the second phase begins. In the second phase, each player selects up to five sports cards 30 acquired in the first game phase, and prepares to dispose of them for scrip 10. The player whose turn it is throws the die 28, and notes the color of the field 28B of the exposed facet 32. The color corresponds to a similar color of a portion 40 of the sports card 30 bearing a number 42A, 42B, or 42C representing a possible selling price. The number 42A, 42B, or 42C thus corresponding is the selling price of its associated selected card 30, and that player surrenders all those cards 30 to the banker for the sum thus determined of the value of all five cards 30, proceeds in scrip 10 being distributed from the bank's holdings.

Again, play in the second phase proceeds on a rotating basis, until all players have completed disposal of their respective cards 30, including cards 30 acquired from one another. Players then tally their amassed wealth, as represented by scrip 10, the greatest wealth determining the game winner.

In the preferred embodiment of the invention, there are 75 spaces 22 on the game board 14 with five initial spaces 24. Also there are seventy-five sets of five identical cards 40, for a total of three hundred seventy-five cards 40. With further reference to FIG. 3, the indicia immediately above and below the player are intended to represent football field end zones, while the indicia at the very top of the card indicate a particular, known football player with his entry year into the National Football League at the left and his playing position indicated at the right. This indicia is provided only to enhance attractiveness of the game and has no real role in the playing of the game. Although football is chosen as background for the game in the preferred embodiment, obviously other sports could be chosen, such as baseball, basketball, hockey, etc.

It is to be understood that the present invention is not limited to the sole embodiment described above, but encompasses any and all embodiments within the scope of the following claims.

We claim:

1. A game apparatus for playing by at least two people, the apparatus comprising game board means, a plurality of card means, game pieces, chance means, and symbolic value means, said game board means including indicia demarcating thereon a plurality of spaces arranged sequentially, thus defining a path, and, within each said space, further indicia displaying a plurality of predetermined numerical values denoting possible acquisition cost of one of said plurality of card means, displaying symbols corresponding to said acquisition costs and correlating said chance means, and representing a sports figure, whereby each one of said plurality of spaces is given identity so as to be distinguishable from other said spaces and also is associated with one of said plurality of card means, said plurality of card means bearing indicia thereon, first indicia representing a sports figure providing identify so that each one of said plurality of card means is distinguishable from other said card means, second indicia indicating a plurality of numerical values denoting possible selling prices, and a plurality of third indicia corresponding to said selling prices and correlating with said chance means, said game pieces progressing along said game board means, and occupying any one of said plurality of spaces while progressing, said chance means having a plurality of facets, one of said plurality being exposed at any one time, each one of said plurality of facets bearing a first indicia including a plurality of different numerical values, whereby said chance means determine progression of said game pieces along said game board means and each one of said plurality of facets also bearing a second indicia correlating to said third indicia of said plurality of card means, a match between one of said chance means numerical values and one of said board space first numerical values making definite a variable acquisition cost of one of said plurality of card means, a match between one of said chance means second indicia and one of said card means third indicia making definite a variable selling price of said card means, and wherein said symbolic value means symbolizes money, whereby a maximum score, and thus a winning player, is determined upon completion of play.

2. The game apparatus according to claim 1, further including additional board spaces comrpising indicia instructing a player to pay out or to receive symbolic value.

3. The game apparatus according to claim 2, said chance means comprising at least one die having colored fields.

4. The game apparatus according to claim 2, said board space plurality of numerical values denoting possible acquisition cost of one of said plurality of card means numbering three differing numerical values, said card second indicia indicating a plurality of numerical values denoting possible selling prices numbering three differing numerical values, said card third indicia correlating with one of said chance means exposed facets comprising colored fields, and said chance means having six facets, each of said six facets including indicia exclusively representing the numbers one, two, three, four, five and six, whereby one of said six facets, upon being exposed, determines progress of said game pieces along said board means, said six facets also having colored fields wherein two of said six facets have fields of a first color, another two of said six facets have fields of a second color, and still another two of said six facets have fields of a third color, whereby any one of said colored fields of said six facets correlates to a said card third indicia colored field, thus determining a card means selling price.

5. The game apparatus according to claim 1, said board space plurality of numerical values denoting possible acquisition cost of one of said plurality of card means numbering three differing numerical values, said card second indicia indicating a plurality of numerical values denoting possible selling prices numbering three differing numerical values, said card third indicia correlating with one of said chance means exposed facets comprising colored fields, and said chance means having six facets, each of said six facets including said chance means just indicia exclusively representing the numbers one, two, three, four, five and six, whereby one of said six facets, upon being exposed, determines progress of said game pieces along said board means, said six facets also having said chance means second indicia representing colored fields wherein two of said six facets have fields of a first color, another two of said six facets have fields of a second color, and still another two of said six facets have fields of a third color, whereby any one of said colored fields of said six facets correlates to a said card third indicia colored field, thus determining a card means selling price.

6. A game apparatus for playing by at least two people, the apparatus comprising game board means, a plurality of card means, game pieces, chance means, and symbolic value means, said game board means including indicia demarcating thereon a plurality of first and second spaces arranged sequentially, thus defining a path, and, within each said first space, further indicia displaying a plurality of predetermined numerical values denoting possible acquisition cost of one of said plurality of card means, displaying symbols corresponding to said acquisition costs and correlating to said chance means, and representing a sports figure, whereby each one of said plurality of spaces is given identity so as to be distinguishable from other said spaces and also is associated with one of said plurality of card means, said second spaces comprising indicia instructing a player to pay out or to receive symbolic value, said plurality of card means bearing indicia thereon, first indicia representing a sports figure providing identity so that each one of said plurality of card means is distinguishable from other said card means, second indicia indicating a plurality of numerical values denoting possible selling prices, and a plurality of third indicia corresponding to said selling prices and correlating with said chance means, said game pieces progressing along said game board means, and occupying any one of said plurality of spaces while progressing, said chance means having a plurality of facets, one of said plurality being exposed at any one time, each one of said plurality of facets bearing a first indicia including a plurality of different numerical values, whereby said chance means determine progression of said game pieces along said game board means and each one of said plurality of facets also bearing a second indicia correlating to said third indicia of said plurality of card means, a match between one of said chance means numerical values and one of said board space first numerical values making definite a variable acquisition cost of one of said plurality of card means, a match between one of said chance means second indicia and one of said card means third indicia making definite a variable selling price of said card means, and wherein said symbolic value means symbolizes money, whereby a maximum score, and thus a winning player, is determined upon completion of play.

7. The game apparatus according to claim 6, said board space plurality of numerical values denoting possible acquisition cost of one of said plurality of card means numbering three differing numerical values, said card second indicia indicating a plurality of numerical values denoting possible selling prices numbering three differing numerical values, said card third indicia correlating with one of said chance means exposed facets comprising colored fields, and said chance means having six facets, each of said six facets including said chance means first indicia exclusively representing the numbers one, two, three, four, five and six, whereby one of said six facets, upon being exposed, determines progress of said game pieces along said board means, said six facets also having said chance means second indicia representing colored fields wherein two of said six facets have fields of a first color, another two of said six facets have fields of a second color, and still another two of said six facets have fields of a third color, whereby any one of said colored fields of said six facets correlates to a said card third indicia colored field, thus determining a card means selling price.

* * * * *